United States Patent [19]

Tomich

[11] 4,182,306

[45] Jan. 8, 1980

[54] HEAT TRANSFER DEVICE

[76] Inventor: John L. Tomich, 2102 Apollo Rd., Richardson, Tex. 75081

[21] Appl. No.: 864,327

[22] Filed: Dec. 27, 1977

[51] Int. Cl.[2] ..... F24B 7/00

[52] U.S. Cl. ..... 126/121; 165/105; 165/DIG. 2; 165/DIG. 12; 237/51

[58] Field of Search ..... 126/121, 132; 165/105, 165/DIG. 2, DIG. 12; 62/119; 237/51

[56] References Cited

U.S. PATENT DOCUMENTS

| | | | |
|---|---|---|---|
| 366,877 | 1/1887 | Reynolds | 237/56 |
| 1,419,810 | 7/1922 | Brammer | 126/132 |
| 1,467,229 | 9/1923 | Collver | 126/121 |
| 1,549,071 | 8/1925 | Dodge | 126/132 |
| 1,786,453 | 12/1930 | Risdon | 126/132 |
| 2,131,635 | 9/1938 | Mullen | 237/12.3 B |
| 2,171,944 | 9/1939 | Mullen | 165/41 |
| 2,195,970 | 4/1940 | Monson | 237/12.3 B |
| 2,499,736 | 3/1950 | Afkleen | 62/119 |
| 3,194,308 | 7/1965 | Haried | 165/107 |
| 3,692,103 | 9/1972 | Andoniev et al. | 62/119 |
| 3,854,454 | 12/1974 | Lazaridis | 165/105 |
| 3,884,292 | 5/1975 | Pessolano et al. | 165/105 |
| 3,930,491 | 1/1976 | Miller | 126/121 |
| 3,968,787 | 7/1976 | Basiulis | 165/105 |
| 4,083,398 | 4/1978 | Fallon, Jr. et al. | 165/DIG. 2 |
| 4,090,492 | 5/1978 | Simmons | 165/DIG. 2 |

*Primary Examiner*—Ronald C. Capossela
*Attorney, Agent, or Firm*—Gerald G. Crutsinger

[57] ABSTRACT

A heat transfer device for transferring excessive waste heat from the upper portion of a fireplace to the room comprising a high temperature heat exchanger positioned above the fire grate between the fire and the flue of the fireplace. A mass transfer tube communicates between the heat exchanger and the low temperature heat exchanger positioned above the lintel on the fireplace. A heat transfer fluid is secured within the hollow high temperature heat exchanger such as trichloromonofluoromethane such that as the fluid boils, the heat of the fire the liquid turns to a gas and moves through the mass transfer tube to low temperature exchanger. The fluid cools and gives up its heat to the low temperature exchanger which in turn gives up the heat to ambient air. As the fluid cools, it becomes a liquid again and flows back down the transfer tube from which it came to the high temperature exchanger. If desired, a blower may be provided to force air across the low temperature exchanger to provide a more efficient exchange of heat.

10 Claims, 6 Drawing Figures

HEAT TRANSFER DEVICE

BACKGROUND

This invention relates to a more efficient device to transfer heat from the fireplace to the room and utilization of the waste heat which normally goes up the chimmey flue. Several devices have been developed which tend to utilize the waste heat from the fireplace.

One such device consists of bent tubing in an arc supported together to form a cradle for the burning logs to sit on. The air passes through the tubes from the bottom and is projected into the room by natural convection or forced air. Problems develop with the excessively high temperature experienced at the tube outlet of this device which cause a low air flow rate under natural convection. Forced air convection fans are esthetically obtrusive in that they are not normally built into a fireplace and must sit out in open view. Further they can be easily damaged when feeding logs into the fireplace.

Other such devices utilize the installation of duct work into the brick work of the fireplace utilizing an air heat exchanger which passes through the flue to collect heat and out into the room. These devices cannot be added to existing fireplaces and require constant inspection to be sure that they maintain their seal to prevent carbon monoxide from leaking into the room through a leak within the heat exchanger.

Further, several devices in the past have utilized steam in a closed circulatory system requiring pumps, expansion valves, and large storage boilers be built into the fireplace and which cannot readily be added to existing fireplaces.

SUMMARY

I have devised a heat transfer device comprising a high temperature heat exchanger which is positioned above the fire grate just below the damper of the flue. The high temperature heat exchanger communicates through a transfer tube with a low transfer heat exchanger positioned above the lintel in a normal position occupied by the mantel. The low temperature heat exchanger comprises a thin coil and may be covered with natural wood having vent passages on the bottom and top to allow flow of air across the low temperature heat exchanger.

A charge of heat transfer fluid such as trichloromonofluoromethane generally known as refrigerant 11 having a low boiling point and high heat of evaporization is injected into the system. The heat transfer fluid normally being in a liquid state settles to the high temperature heat exchanger. When a fire is built in the fireplace, the heat rising through the flue will heat up the high temperature heat exchanger transferring the heat to the heat transfer fluid which boils and travels up the transfer tubes to a low temperature exchanger. The gas disperses through the low temperature heat exchanger and transfers the heat to the coils and fins of low temperature heat exchanger. As the gas gives up heat, the fluid turns from a gas to a liquid again. The low temperature heat exchanger transfers heat to ambient air which is moved either by convection or forced air currents across the coil of the temperature heat exchanger. Once the fluid becomes a liquid, it flows back through the transfer tube to the high temperature heat exchanger.

The primary object of the invention is to provide apparatus to transfer the waste heat from above a fire in a fireplace to the room to more efficiently utilize the wood burning fireplaces.

A still further object of the invention is to provide a simple apparatus capable of transferring heat from a fireplace which does not require any structural changes of the fireplace and which may be esthetically pleasing to the eye.

A still further object of the invention is to provide a heat transfer apparatus which may be readily installed on the existing fireplace which is safe and may be readily inspected for problems.

A still further object of the invention is to provide apparatus for transferring heat from the fireplace to a room which is economically feasible to the average homeowner and fireplace user.

Other and further objects of the invention will become apparent upon studying the detailed description hereinafter following and the drawings annexed hereto.

BRIEF DESCRIPTION OF THE DRAWINGS

Drawings of three preferred embodiments of the invention are annexed hereto so that the invention may be better and more clearly understood, in which.

Numerals references are used to designate like parts throughout the various figures of the drawings.

BRIEF DESCRIPTION OF THE PREFERRED EMBODIMENT

Figure 1:
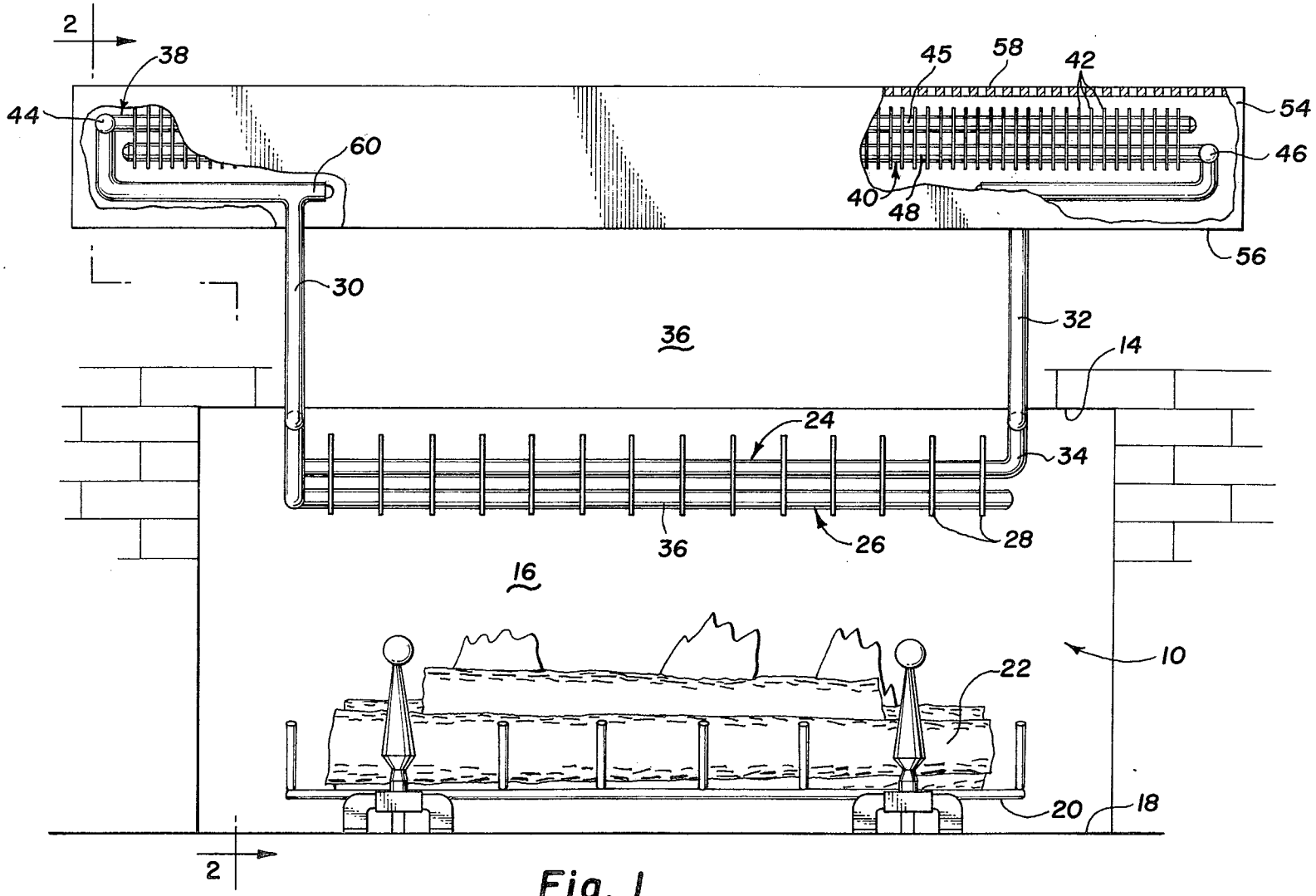
FIG. 1 is a front elevational view of the heat exchange device secured within a fireplace with parts broken away to more clearly illustrate the details of construction.
Figure 2:
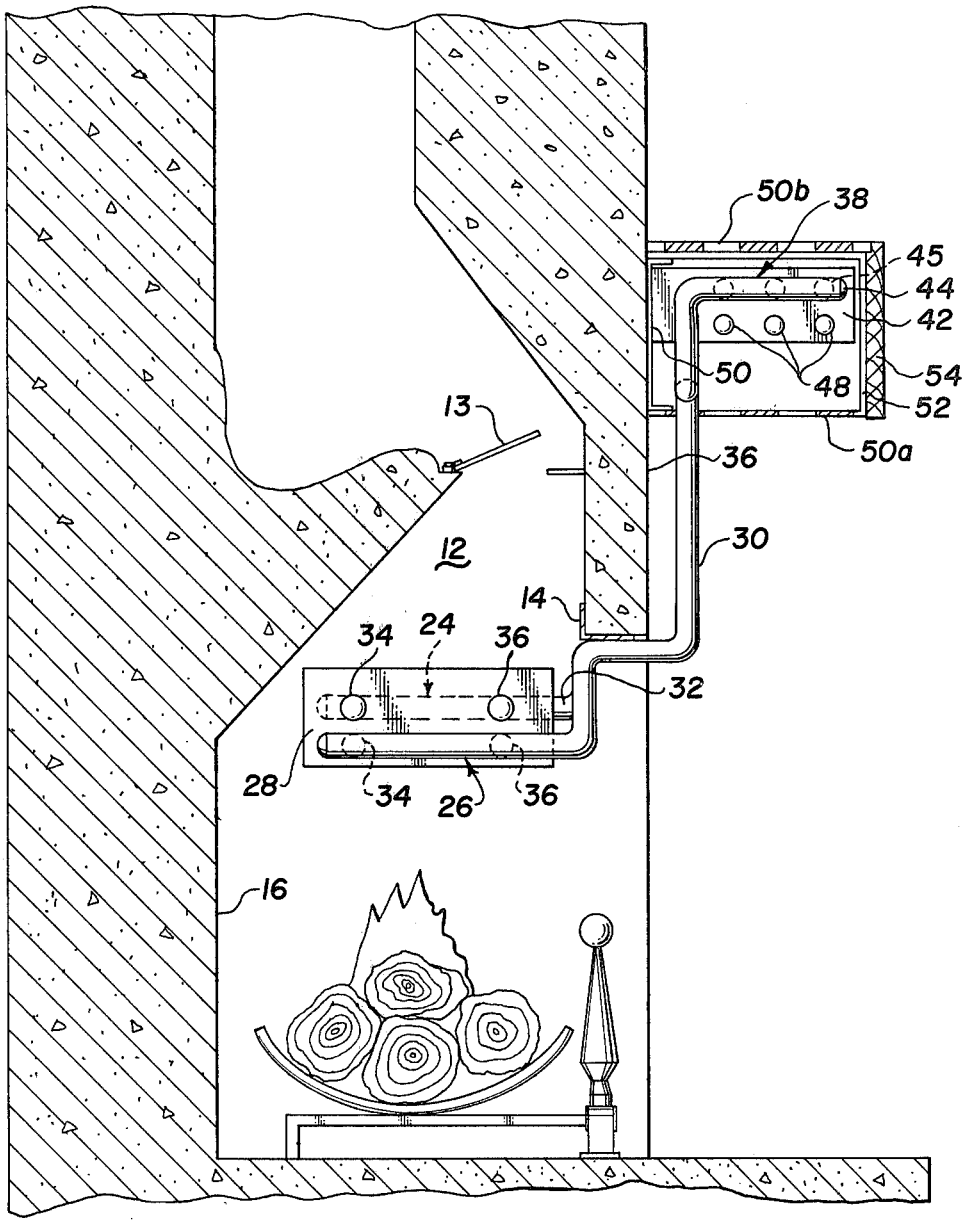
FIG. 2 is sectional end view of the heat transfer device with parts broken away to more clearly illustrate the details of construction.
Figure 5:
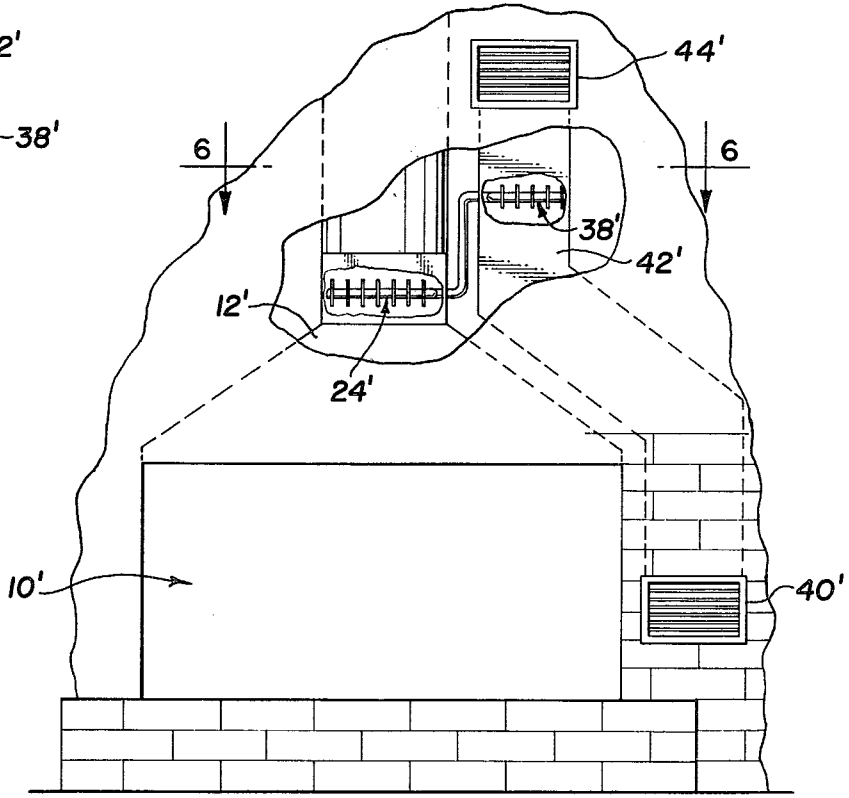
FIG. 5 is an elevational view diagrammatically showing a modified form of heat exchanger.
Figure 6:
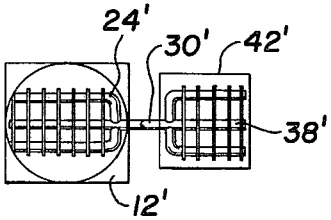
FIG. 6 is a cross-sectional view taken along line 6—6 of FIG. 5.

Referring to FIGS. 1 and 2 of the drawing, a typical fireplace is having an opening 10, flue 12, damper 13, and lintel 14. Rear wall 16 and floor 18 form the firebox of the fireplace. A grate 20 provides a cradle for the logs 22 and the fire.

A lower high temperature heat exchange means comprising evaporative coils 24 and 26 secured in parallel relationship in a radiating fins 28. Evaporative coils 24 and 26 preferably comprise two parallel tubes 34 and 36 each which communicate with transfer tubes 30 and 32. The two tubes 34 and 36 of coils 24 and 26 must be in a level plane for proper operation. Coil 24 communicates with transfer tube 32 and coil 26 communicates with transfer tube 30. The evaporative coils 24 and 26 are preferably fabricated from copper and steel alloys due to the high heat level just above the fire.

Transfer tubes 30 and 32 comprise hollow conduits which communicate with an upper low temperature heat exchange means such as a pair of condensing coils 38 and 40 secured in a bank of radiating fins 42. Transfer tube 30 communicates through manifold 44 with three hollow tubes 45 fabricated of the heat transfer material such as copper and transfer tube 32 communicates with manifold 46 with three tubes 48 on the upper side of manifold 44.

A support frame comprising a C channel 50 secured to the face 36 of the fireplace and a perforated metal plenum 52 supports the evaporative coils 38 and 40. The channel 50 may be covered with wood or the like so long as the ventilation from the lower side 50*a* to the upper side 50*b* is maintained.

The wooden frame may consist of a center board 54 and perforated metal 56 and 58 on the lower and upper surfaces of plenum 52.

A charge of heat transfer fluid is sealed in the heat transfer device to transfer heat from the fireplace to the room. The heat transfer fluid may be one of several types such as refrigerants, water, or other suitable heat transfer fluids, however, experiments have shown that refrigerant 11, a trichloromonofluoromethane compound commonly sold under the tradename Freon-11 is preferred. A refrigerant-11 is non-flammable and has a boiling point of 23.7 degrees Celsius which is just above room temperature. The fluid has a high heat of vaporization which is desirable in this particular device because of the low working pressures of the fluid. The refrigerant is in a liquid state when the liquid drains toward the high temperature heat exchanger means. The heat from the fire heats the fluid causing it to vaporize and absorb the heat from the coils 24 and 26 in the flue area of the fireplace. The fluid flows as a gas from evaporative coils 24 and 26 into transfer tubes 30 and 32 and toward condensing coils 38 and 40 above the fireplace lintel 14. In coils 38 and 40 the vapor condenses giving off its heat raising the temperature of the coils 38 and 40 about 50 to 75 degrees F. above room temperature. The room air moving over the external surface of low temperature condensing coils 38 and 40 from the lower surface 50*a* to the upper surface 50*b* of the condensing coils. After the fluid has condensed and become a liquid within coils 38 and 40, the liquid runs back through the mass transfer tubes 30 and 32, returning to the evaporative coils 24 and 26. It is desirable to have two parallel coils because of the fluid capacity of tubes 30 and 32 which should be kept to a small diameter so as not to be obtrusive when placed on the fireplace. Further, the two circuits provide more even heat distribution and a more efficient transfer of the heat from the flue 12 to the room air.

A safety heat fusible plug 60 is provided on the upper end of tubes 30 and 32 such that excessive pressure built up in tubes 30 and 32 will expand the fusible link and relieve the pressure if necessary.

Figure 3:
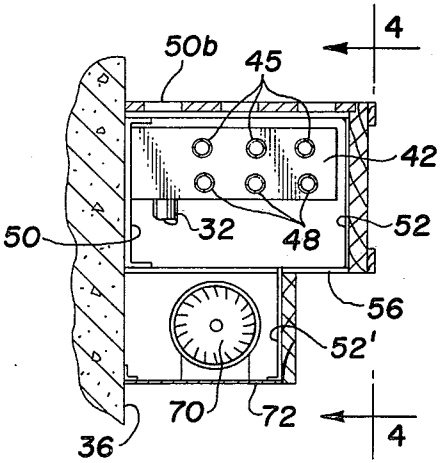
FIG. 3 is a sectional end view of a modified form of the low temperature heat exchanger similar to that shown in FIG. 2.
Figure 4:
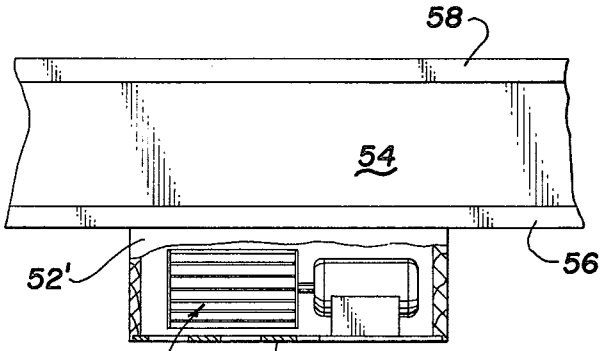
FIG. 4 is an elevational view thereof.

A modified form as illustrated in FIGS. 3 and 4 in which a bottom 56 of the mantel is shortened and plenum 52 is deflected downwardly to form a horizontal opening across the bottom of the mantel. A rotary blower fan 70 is positioned in the plenum to draw air in through opening 72 formed in deflected plenum 52'. Air is forced across the bottom of coils 38 and 40 and through the openings in the top of board 58. This provides a more efficient transfer of cool air across the warm coils and out into the room. The deflected plenum 52' may be covered by wood or other surfaces to provide a more finished look for the home. The fan 70 is positioned in a suitable position depending on the design and type of fireplace so as not to draw air from the fire.

A still further embodiment of the heat exchanger has a typical fireplace having an opening 10' and flue pipe 12' wherein the evaporative coil 24' is positioned in the flue pipe 12' and transfer tubes 30' communicate with a low temperature heat exchanger 38' positioned adjacent and slightly above the high temperature heat exchanger 24'. The low temperature heat exchanger is positioned in a plenum 42' which has an intake grill 40' and an outlet grill 44'. Air passes by convexion or may be forced by a fan (not shown) from intake 40' across low temperature heat exchanger 38' and out outlet 44' into the room when the device is used with a prefabricated fire place or other suitable type of construction.

It should be readily apparent that a decorative cover may be secured over plenum 52 to cover the condensing coils 38 and 40 so that the device will be esthetically pleasing to the eye. The cover could be constructed of wood or polished metal. Further, the condensing coils 38 and 40 could form an art work design of metal such as a metal scupture of a ship or other device constructed of copper or other metals.

It should be readily apparent that other and further embodiments of the invention may be devised without departing from the basic concept herein.

Having described my invention, I claim:

1. Apparatus to transfer heat from a fireplace to a room comprising: a first heat exchanger means positioned above the fire within the fireplace; a second heat exchanger means positioned in a remote location within the room at a level above the first heat exchanger; a connector tube connecting the first heat exchanger means with the second heat exchanger means; and heat transfer fluid disposed within the first heat exchanger means such that heat rising from the fireplace will cause the transfer fluid within the first heat exchanger to boil with the vapor rising through the connecting tube to the second heat exchanger means, said vapor giving up its heat in the second heat exchanger means and condensing back to a liquid which falls back through the connecting tube to the first heat exchanger means, said second heat exchanger means transferring the heat to the surrounding air for heating the room.

2. The combination called for in claim 1 with the addition of: a blower, said blower being adapted to blow air across the second heat exchanger means.

3. The combination called for in claim 1 wherein the first heat exchanger means comprises one or more tubes constructed of heat resistant material; fins formed about said tube to transfer heat to said tube; and wherein said second heat exchanger means comprises one or more tubes disposed horizontally and having radiating fins secured thereto to aid in radiating the heat from the tube to the air surrounding the tube.

4. The combination called for in claim 1 with the addition of: a third heat exchanger means disposed in parallel relationship to the first heat exchanger means just above the fire; a fourth heat exchanger means disposed in parallel relationship with the second heat exchanger means and second connector means connecting the third heat exchanger means to the fourth heat exchanger means; and heat transfer fluid disposed in said third and fourth heat exchanger means.

5. Apparatus to transfer heat from a fireplace to a remote location in a room comprising: a first evaporative coil constructed of heat resistant material adapted to be disposed in a level horizontal relationship above a floor of the fireplace; a condensing coil adapted to be disposed in a horizontal relationship at a level above the evaporative coil for transferring heat to the surrounding air; a tube connecting the evaporative coil to the condensing coil; and a heat transfer fluid disposed in the evaporative and condensing coils, said heat transfer fluid being a liquid at room temperature and a gas at higher temperatures such that the heat transfer fluid within the evaporative coil is evaporated by the heat of the fire with the gas rising through the connecting tube to the condensing coil wherein the gas heat transfer fluid condenses back to a liquid, said liquid heat transfer fluid flowing back through the connecting tube toward the evaporative coil as the condensing coil heats the air to thereby heat the room.

6. The combination called for in claim 5 wherein the heat transfer fluid comprises trichloromonofluoromethane.

7. The combination called for in claim 5 with the addition of: a second evaporative coil disposed in parallel relationship with the first evaporative coil; a second condensing coil disposed in parallel relationship with the first condensing coil; a second connecting tube connecting the second evaporative coil with the second condensing coil; and heat transfer fluid disposed in the second evaporative coil and second condensing coil to transfer heat from the second evaporative coil to the second condensing coil.

8. The combination called for in claim 5 wherein said evaporative coil comprises two or more tubes disposed in a horizontal level plane and constructed of heat resistant material connected to a single connecting tube.

9. The combination called for in claim 5 with the addition of: a blower to force the air across the condensing coil which heats the air as it passes across the condensing coil.

10. The combination called for in claim 5 with the addition of: a decorative cover formed over the condensing coil to cover the coil transfer fluid condenses back to a liquid, said heat transfer fluid in liquid state flowing back through the connecting tube toward the evaporative coil as the condensing coil heats the air surrounding same.

* * * * *